US012808115B2

(12) United States Patent
Lee et al.

(10) Patent No.: US 12,808,115 B2
(45) Date of Patent: Nov. 24, 2026

(54) GARMENT MANAGEMENT DEVICE, METHOD OF CONTROLLING THE GARMENT MANAGEMENT DEVICE, AND GARMENT STORAGE BOX

(71) Applicant: Samsung Electronics Co., Ltd., Suwon-si (KR)

(72) Inventors: Myungwoo Lee, Suwon-si (KR); Byeongcheol Yoon, Suwon-si (KR); Chihong Cho, Suwon-si (KR); Younghak Kong, Suwon-si (KR); Hyelim Park, Suwon-si (KR); Soohyun Sung, Suwon-si (KR); Myoungsoo Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 135 days.

(21) Appl. No.: 18/767,467

(22) Filed: Jul. 9, 2024

(65) Prior Publication Data

US 2025/0075410 A1 Mar. 6, 2025

Related U.S. Application Data

(63) Continuation of application No. PCT/KR2024/095845, filed on May 22, 2024.

(30) Foreign Application Priority Data

Aug. 28, 2023 (KR) ..... 10-2023-0113196
Oct. 20, 2023 (KR) ..... 10-2023-0141409

(51) Int. Cl.
*D06F 58/10* (2006.01)
*D06F 103/06* (2020.01)
(Continued)

(52) U.S. Cl.
CPC ..... *D06F 58/10* (2013.01); *D06F 2103/06* (2020.02); *D06F 2103/34* (2020.02); *D06F 2105/32* (2020.02)

(58) Field of Classification Search
None
See application file for complete search history.

(56) References Cited

U.S. PATENT DOCUMENTS

2011/0047814 A1 3/2011 Watson et al.
2017/0260681 A1 9/2017 Gao et al.
(Continued)

FOREIGN PATENT DOCUMENTS

CN 112668355 A 4/2021
CN 213624891 U 7/2021
(Continued)

OTHER PUBLICATIONS

JP 2004355228 A machine translation, Washing Management Device, and Cleaning Intermediating Method and System Using Washing Management Device, Okamura (Year: 2004).*
(Continued)

*Primary Examiner* — Cristi J Tate-Sims
(74) *Attorney, Agent, or Firm* — STAAS & HALSEY LLP

(57) ABSTRACT

A garment management device including a management chamber; a blowing device to generate airflow in the management chamber; a garment storage box, accommodatable in the management chamber, including a case, garment shelf, ventilation module to circulate air through the garment storage box, and sensor module to detect humidity inside the garment storage box; and at least one processor to detect whether the garment storage box is in the management chamber, and, when the garment storage box is detected in the management chamber, establish a communication con-
(Continued)

nection with the garment storage box, operate the blowing device so that the airflow is generated in the management chamber, and operate the ventilation module so that the airflow in the management chamber is circulated through the garment storage box, detect the humidity inside the garment storage box, and, based on the detected humidity, control operation of the blowing device and the ventilation module.

20 Claims, 15 Drawing Sheets

(51) Int. Cl.
*D06F 103/34* (2020.01)
*D06F 105/32* (2020.01)

(56) References Cited

U.S. PATENT DOCUMENTS

| | | | | |
|---|---|---|---|---|
| 2018/0121773 | A1 | 5/2018 | Tercsinecz | |
| 2021/0301457 | A1* | 9/2021 | Choi | B29C 44/18 |
| 2022/0034023 | A1* | 2/2022 | Hong | D06F 73/02 |

FOREIGN PATENT DOCUMENTS

| | | | |
|---|---|---|---|
| CN | 116369676 | A | 7/2023 |
| JP | 2008-206632 | | 9/2008 |
| JP | 2012-200584 | | 10/2012 |
| JP | 2021-186258 | | 12/2021 |
| KR | 20-0335971 | | 12/2003 |
| KR | 10-2007-0053510 | | 5/2007 |
| KR | 10-0830120 | | 5/2008 |
| KR | 10-2010-0069347 | | 6/2010 |
| KR | 10-2012-0001506 | | 1/2012 |
| KR | 20-2013-001839 | | 3/2013 |
| KR | 10-2013-0055487 | | 5/2013 |
| KR | 10-1445382 | | 10/2014 |
| KR | 10-2015-0106473 | | 9/2015 |
| KR | 10-1703142 | | 2/2017 |
| KR | 10-1736804 | | 5/2017 |
| KR | 10-2020-0065886 | | 6/2020 |
| KR | 10-2020-0076144 | | 6/2020 |
| KR | 10-2259419 | | 6/2021 |
| KR | 10-2022-0073997 | | 6/2022 |
| KR | 10-2490219 | | 1/2023 |

OTHER PUBLICATIONS

International Search Report and Written Opinion of the International Searching Authority dated Aug. 27, 2024 for International Application No. PCT/KR2024/095845.
Extended European Search Report dated Jun. 30, 2026 for EP Patent Application No. 24860511.5 In English.

* cited by examiner

FIG. 7

| HUMIDITY INSIDE GARMENT STORAGE BOX | BLOWING DEVICE | VENTILATION MODULE |
|---|---|---|
| GREATER THAN OR EQUAL TO 0 % BUT LESS THAN 60 % | STOP | STOP |
| GREATER THAN OR EQUAL TO 60 % BUT LESS THAN OR EQUAL TO 100 % | OPERATE | OPERATE |

GARMENT MANAGEMENT DEVICE, METHOD OF CONTROLLING THE GARMENT MANAGEMENT DEVICE, AND GARMENT STORAGE BOX

CROSS-REFERENCE TO RELATED APPLICATIONS

This application is a continuation application, under 35 U.S.C. § 111(a), of International Application No. PCT/KR2024/095845, filed on May 22, 2024, which claims priority under 35 U.S.C. § 119 to Korean Provisional Application No. 10-2023-0113196, filed on Aug. 28, 2023, and Korean Patent Application No. 10-2023-0141409, filed on Oct. 20, 2023, the disclosures of which are incorporated by reference herein in their entireties.

TECHNICAL FIELD

The disclosure relates to a garment management device, a method of controlling the garment management device, and a garment storage box. More particularly, the disclosure provides a garment storage box for intelligently storing garments, a garment management device for accommodating the garment storage box, and a method of managing garments stored in the garment storage box by using the garment management device.

BACKGROUND ART

A garment management device may be a home appliance for managing garments in a home. The garment management device may perform deodorization, wrinkle removal, drying, and sterilization on garments. The garment management device may keep a garment clean by applying steam, wind, and heat to the garment. The garment management device may quickly manage garments in a home.

A garment storage box may be a box that stores garments in a home. The garment storage box may store organized garments. The garment storage box may protect the garments from external foreign substances.

The garments stored in the garment storage box for a long period of time may become humid due to air inside the garment storage box. In order to remove moisture from the garments stored in the garment storage box, the garments may be taken out of the garment storage box and then ventilated or dried in a garment management device. A user needs to manually manage the garments stored in the garment storage box on a regular basis. Accordingly, it may be difficult to remove moisture from the garments stored in the garment storage box, and manage the garments in the garment storage box for a long period of time.

A plurality of garment storage boxes may be arranged inside a home. The garment storage boxes may be arranged in or moved to various locations inside the home. Accordingly, it may be difficult for the user to identify which garment storage box in the home a garment that the user wishes to find is stored.

DISCLOSURE

Technical Solution

Aspects of embodiments of the disclosure will be set forth in part in the description which follows and, in part, will be apparent from the description, or may be learned by practice of the presented embodiments.

According to an embodiment of the disclosure, a garment management device includes a management chamber; a blowing device configured to generate an airflow in the management chamber; a garment storage box in which a garment is storable, and configured to be accommodatable in the management chamber, the garment storage box including a case, a garment shelf, a ventilation module configured to circulate air through the garment storage box, and a sensor module configured to detect humidity inside the garment storage box; and at least one processor configured to detect whether the garment storage box is accommodated in the management chamber, and, when it is detected that the garment storage box is accommodated in the management chamber, establish a communication connection with the garment storage box, and, via the established communication connection, operate the blowing device so that the airflow is generated in the management chamber, and operate the ventilation module so that the airflow in the management chamber is circulated through the garment storage box, detect the humidity inside the garment storage box through the sensor module while the airflow in the management chamber is circulated through the garment storage box, and based on the detected humidity, control operation of the blowing device and operation of the ventilation module.

According to an embodiment of the disclosure, the at least one processor may be configured to, based on the detected humidity being greater than a threshold value, maintain the operation of the blowing device and the operation of the ventilation module, and, based on the detected humidity being less than the threshold value, stop the operation of the blowing device and the operation of the ventilation module.

According to an embodiment of the disclosure, the garment storage box may include an identification module. The at least one processor may be configured to, when a garment is stored in the garment storage box, receive, through the identification module, garment information related to the garment stored in the garment storage box from a tag of the garment, and control the operation of the blowing device and the operation of the ventilation module based on the received garment information.

According to an embodiment of the disclosure, the garment information may include at least one of a type of the garment, a shape of the garment, a size of the garment, a material of the garment, or a color of the garment.

According to an embodiment of the disclosure, the garment management device may further include an output interface. The at least one processor may be configured to, based on the received garment information, communicate, through the output interface, precautions related to the garment stored in the garment storage box.

According to an embodiment of the disclosure, the at least one processor may be configured to store, in a server, the received garment information, identification information of the garment storage box, and location information of the garment storage box, receive information from a terminal indicating a desired garment, and identify a storage location of the desired garment indicated by the received information from the terminal, based on the stored garment information, the stored identification information, and the stored location information.

According to an embodiment of the disclosure, the at least one processor may be configured to, based on the garment storage box storing the desired garment being detected in the management chamber, communicate, through the output interface, information that the desired garment is stored in the garment storage box.

According to an embodiment of the disclosure, the garment storage box may include a display. The at least one processor may be configured to, based on the garment storage box storing the desired garment not being detected in the management chamber, transmit a tracking signal that operates the display of the garment storage box.

According to an embodiment of the disclosure, provided is a method of controlling a garment management device, the garment management device including a management chamber, a blowing device configured to generate an airflow in the management chamber, a garment storage box in which a garment is storable and configured to be accommodatable in the management chamber, the garment storage box including a ventilation module configured to circulate air through the garment box and a sensor module configured to detect humidity inside the garment storage box, the method including detecting whether the garment storage box is accommodated in the management chamber; and, when it is detected that the garment storage box is accommodated in the management chamber, establishing a communication connection with the garment storage box, and, via the established communication connection, operating the blowing device so that the airflow is generated in the management chamber, and operating the ventilation module so that the airflow in the management chamber is circulated through the garment storage box, detecting the humidity inside the garment storage box through the sensor module while the airflow in the management chamber is circulated through the garment storage box, and, based on the detected humidity, controlling operation of the blowing device and operation of the ventilation module.

According to an embodiment of the disclosure, the controlling of the operation of the blowing device and the operation of the ventilation module may include, based on the detected humidity being greater than a threshold value, maintaining the operation of the blowing device and the operation of the ventilation module, and based on the detected humidity being less than the threshold value, stopping the operation of the blowing device and the operation of the ventilation module.

According to an embodiment of the disclosure, the garment management device may include an identification module, and the method may further include, when a garment is stored in the garment storage box, receiving, through the identification module, garment information related to the garment stored in the garment storage box from a tag of the garment, and controlling the operation of the blowing device and the operation of the ventilation module based on the received garment information.

According to an embodiment of the disclosure, the garment management device may include an output interface, and the method may further include communicating, through the output interface, precautions related to the garment stored in the garment storage box.

According to an embodiment of the disclosure, the method may further include storing, in a server, the received garment information, identification information of the garment storage box, and location information of the garment storage box; receiving information from a terminal indicating a desired garment; and identifying a storage location of the desired garment indicated by the received information from the terminal, based on the stored garment information, the stored identification information, and the stored location information.

According to an embodiment of the disclosure, the method may further include, based on the garment storage box storing the desired garment being detected in the management chamber, communicating, through the output interface, information that the desired garment is stored in the garment storage box.

According to an embodiment of the disclosure, the garment storage box may include a display, and the method may further include, based on the garment storage box storing the desired garment not being detected in the management chamber, transmitting a tracking signal that operates the display of the garment storage box.

According to an embodiment of the disclosure, provided is a garment storage box that is accommodatable in a management chamber of a garment management device, the garment storage box including a case; a garment shelf; a ventilation module configured to circulate air through the garment storage box; a sensor module configured to detect humidity inside the garment storage box; and at least one processor configured to, with the garment storage box accommodated in the management chamber of the garment management device, establish a communication connection with the garment management device, transmit information to the garment management device, via the established communication connection, so that a blowing device of the garment management device generates an airflow in the management chamber, operate the ventilation module so that the airflow in the management chamber is circulated through the garment storage box, detect the humidity inside the garment storage box through the sensor module while the airflow is circulated through the garment storage box, transmit information to the garment management device, via the established communication connection, so that the blowing device is controlled based on the detected humidity, and control operation of the ventilation module based on the detected humidity.

According to an embodiment of the disclosure, the at least one processor may be configured to, based on the detected humidity being greater than a threshold value, transmit information to the garment management device, via the established communication connection, so that the blowing device is controlled to maintain the airflow in the management chamber, and maintain the operation of the ventilation module, and, based on the detected humidity being less than the threshold value, transmit information to the garment management device, via the established communication connection, so that the blowing device is controlled to stop generating the airflow in the management chamber, and stop the operation of the ventilation module.

According to an embodiment of the disclosure, the garment storage box may further include an identification module. The at least one processor may be configured to, when a garment is stored in the garment storage box, receive, through the identification module, garment information related to the garment stored in the garment storage box from a tag of the garment, transmit information to the garment management device, via the established communication connection, so that the blowing device is controlled based on the received garment information, and control the operation of the ventilation module based on the received garment information.

According to an embodiment of the disclosure, the garment information may include at least one of a type of the garment, a shape of the garment, a size of the garment, a material of the garment, or a color of the garment.

According to an embodiment of the disclosure, the garment storage box may further include a display. The at least one processor may be configured to, based on the received garment information, communicate, through the display, precautions related to the garment stored in the garment storage box.

DESCRIPTION OF DRAWINGS

These and/or other aspects of the disclosure will become apparent and more readily appreciated from the following description of embodiments, taken in conjunction with the accompanying drawings of which:

FIG. 7 is a table showing controlling an operation of a blowing device of a garment management device and an operation of a ventilation module of a garment storage box according to the humidity inside the garment storage box, according to an embodiment of the disclosure.

MODE FOR INVENTION

Figure 1:
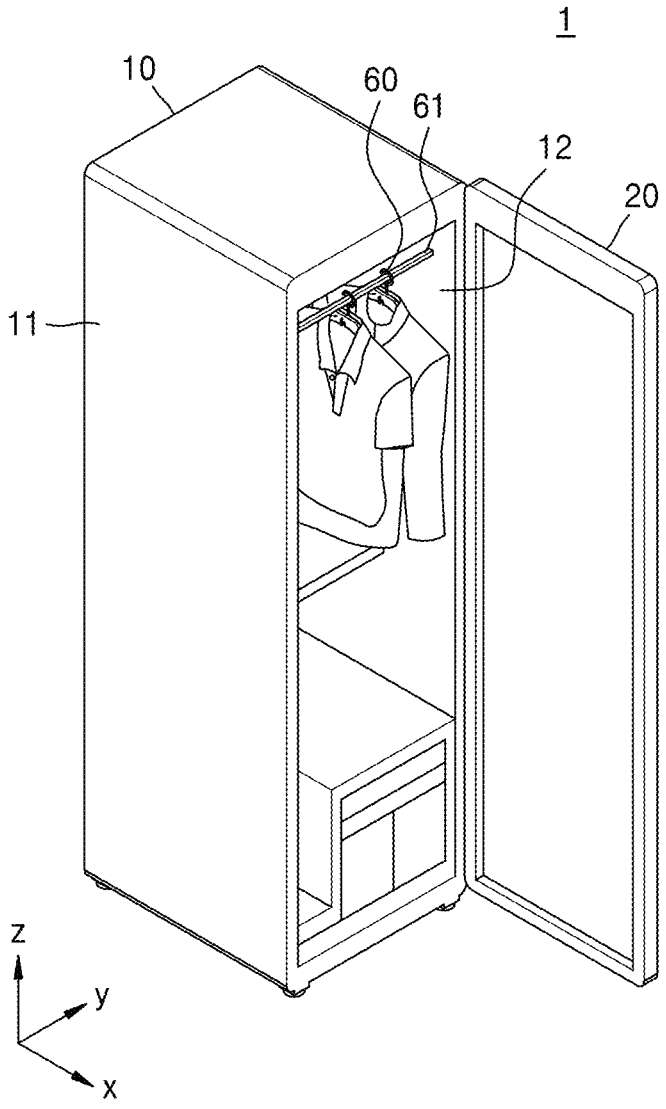
FIG. 1 is a perspective view of a garment management device according to an embodiment of the disclosure.

Terms used herein will be briefly described, and then an embodiment of the disclosure will be described in detail.

Although the terms used herein are selected from among common terms that are currently widely used in consideration of their functions in an embodiment of the disclosure, the terms may be different according to an intention of one of ordinary skill in the art, a precedent, or the advent of new technology. Also, in particular cases, the terms are discretionally selected by the applicant of the disclosure, in which case, the meaning of those terms will be described in detail in the corresponding description of an embodiment of the disclosure. Therefore, the terms used herein are not merely designations of the terms, but the terms are defined based on the meaning of the terms and content throughout the disclosure.

As used herein, the expression "at least one of a, b, or c" may indicate only a, only b, only c, both a and b, both a and c, both b and c, all of a, b, and c, or variations thereof.

Throughout the disclosure, when a part "includes" an element, it is to be understood that the part may additionally include other elements rather than excluding other elements as long as there is no particular opposing recitation. In addition, as used herein, the terms such as " . . . er (or)", " . . . unit", " . . . module", etc., denote a unit that performs at least one function or operation, which may be implemented as hardware or software or a combination thereof.

Hereinafter, an embodiment of the present disclosure will be described in detail with reference to the accompanying drawings to allow those of skill in the art to easily carry out the embodiment. An embodiment of the disclosure may, however, be embodied in many different forms and should not be construed as being limited to the embodiment of the disclosure set forth herein. Also, parts in the drawings unrelated to the detailed description are omitted to ensure clarity of the disclosure, and like reference numerals in the drawings denote like elements.

FIG. 1 is a perspective view of a garment management device 1 according to an embodiment of the disclosure. The garment management device 1 according to an embodiment of the disclosure may include a main body 10 and a door 20.

The main body 10 may form the exterior of the garment management device 1. The main body 10 may include a housing 11. The housing 11 may include at least one sidewall, a lower surface, and an upper surface. For example, the housing 11 may have the shape of a quadrangular prism that is open in a first direction (e.g., the x-axis direction). A management chamber 12 in which garments are accommodated may be provided inside the main body 10. The shape of the management chamber 12 may be defined by the housing 11. For example, in a case in which the housing 11 has the shape of a quadrangular prism, the management chamber 12 may be defined as a space in the shape of a rectangular parallelepiped.

The door 20 may be rotatably coupled to the main body 10. For example, the door 20 may be coupled to one edge of an open portion of the housing 11. The door 20 may open or close the garment management device 1. When a garment is accommodated in the management chamber 12, the door 20 may be opened. When the garment management device 1 operates, the door 20 may remain closed.

A hanger holder 61 may be provided inside the management chamber 12. The hanger holder 61 may be provided in the form of a bar crossing the management chamber 12. For example, the hanger holder 61 may be a bar that crosses an upper part of the management chamber 12 in a second direction (e.g., the y-axis direction) perpendicular to the first direction. The hanger holder 61 may hold a hanger 60.

Figure 2:
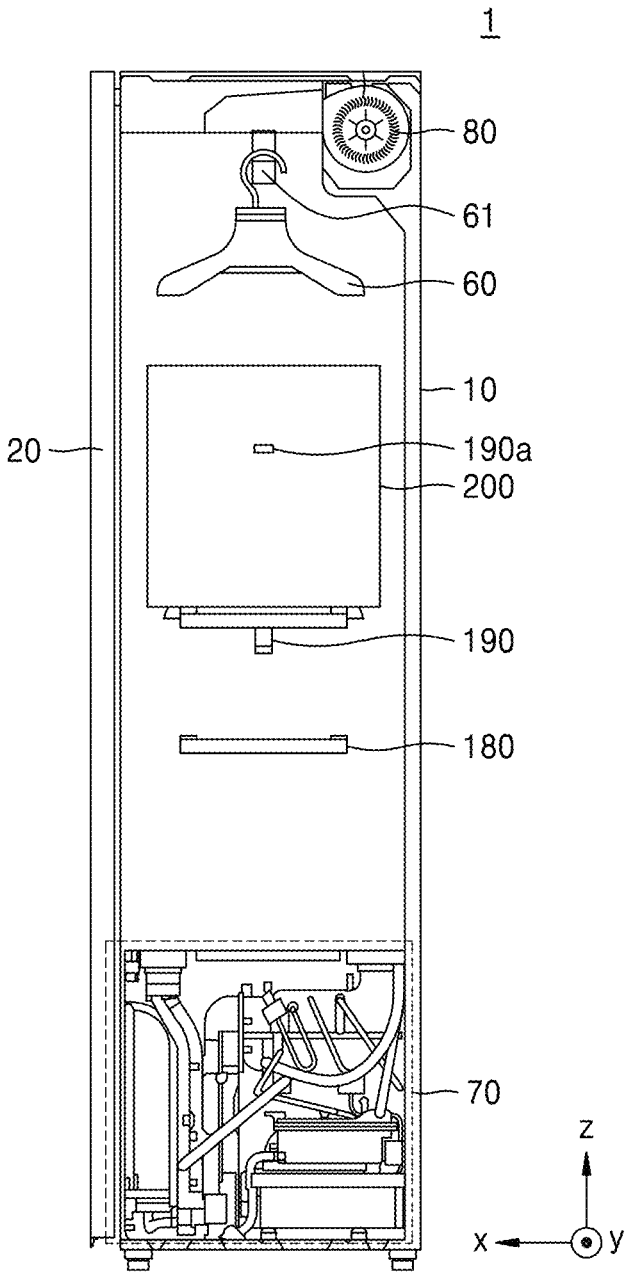
FIG. 2 is a side view of a garment management device in which a garment storage box is accommodated, according to an embodiment of the disclosure.

FIG. 2 is a side view of the garment management device 1 in which a garment storage box 200 is accommodated, according to an embodiment of the disclosure. The garment management device 1 according to an embodiment of the disclosure may accommodate the garment storage box 200 in the main body 10. For example, the garment storage box 200 may be accommodated in the management chamber 12 of the garment management device 1. The garment management device 1 according to an embodiment of the disclosure may include the main body 10, the door 20, a machine chamber 70, a blowing device 80, a garment holder 180, a garment storage box support 190, and at least one processor (not shown).

The machine chamber 70 may be provided in a lower part of the main body 10. The machine chamber 70 may dehumidify or heat air inside the main body 10. The machine chamber 70 may include a heat exchange device. The heat exchange device may include an evaporator, a condenser, and a compressor. The evaporator, the condenser, and the compressor may evaporate, condense, and compress a refrigerant while circulating it. The machine chamber 70 may remove moisture in the air inside the main body 10 and heat the air inside the main body 10, through heat exchange according to the circulation of the refrigerant.

The blowing device 80 may be provided in an upper part of the main body 10. The blowing device 80 may circulate air inside the management chamber 12. The blowing device 80 may include a fan. The blowing device 80 may discharge the air dehumidified and heated in the machine chamber 70, from above the hanger 60. The blowing device 80 may dry and manage a garment on the hanger 60.

The garment holder 180 may be provided at the inner center of the main body 10. The garment holder 180 may be provided on a sidewall of the housing 11. The garment holder 180 may hold garments other than the garment on the hanger 60. For example, the garment holder 180 may hold garments that are not easy to be hung on the hanger 60, such as shoes, hats, scarves, or gloves.

The garment storage box support 190 may support the garment storage box 200. The garment storage box support 190 may be a structure on which the garment storage box 200 may be placed. For example, the garment storage box support 190 may be a plate or shelf on which the garment storage box 200 may be placed. The garment storage box support 190 may have a structure for supporting a load so as to support the garment storage box 200 in which garments are stored. The garment storage box support 190 may be formed of a high-strength material to support the garment storage box 200 in which garments are stored.

The garment management device 1 according to an embodiment of the disclosure may include a connector 190*a* for connecting the garment storage box 200 placed on the garment storage box support 190 to the garment management device 1. The connector 190*a* may connect the garment management device 1 to the garment storage box 200 in a wired manner. Through the connector 190*a*, the garment management device 1 may supply power to the garment storage box 200 or transmit and receive signals and data to and from the garment storage box 200. However, the disclosure is not limited thereto, and the garment management device 1 may be wirelessly connected to the garment storage box 200 to supply power to the garment storage box 200 or transmit and receive signals and data to and from the garment storage box 200.

The at least one processor included in the garment management device 1 may control the overall operation of the garment management device 1. The at least one processor may control start and stop of an operation of the garment management device 1. When the garment management device 1 and the garment storage box 200 are wirelessly connected to each other, the at least one processor may control the overall operation of the garment storage box 200.

Figure 3:
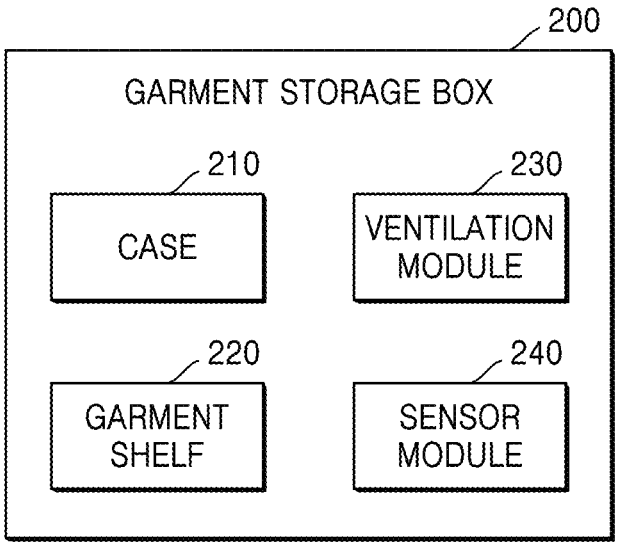
FIG. 3 is a block diagram of a garment storage box according to an embodiment of the disclosure.

FIG. 3 is a block diagram of a garment storage box 200 according to an embodiment of the disclosure. The garment storage box 200 according to an embodiment of the disclosure may include a case 210, a garment shelf 220, a ventilation module 230, and a sensor module 240.

The case 210 may form the exterior of the garment storage box 200. The case 210 may have a shape for storing garments. For example, the case 210 may be in the shape of a box. The case 210 may include a cover. The cover may be coupled to one surface of the case 210. For example, the cover may be coupled to the upper surface of the case 210 to be rotatable or in a sliding structure. The cover may open or close the garment storage box 200. The cover may be opened when putting a garment into the garment storage box 200 or taking a garment out of the garment storage box 200. When garments are stored in the garment storage box 200, the cover may remain closed.

The garment shelf 220 may be provided on an inner surface of the case 210. The garment shelf 220 may support the garments stored in the garment storage box 200. The garment shelf 220 may distinguish between the garments stored in the garment storage box 200. The garment shelf 220 may provide a ventilation space for the garments stored in the garment storage box 200.

The ventilation module 230 may be provided on one side of the case 210. For example, the ventilation module 230 may be provided to penetrate a side surface of the case 210. The ventilation module 230 may include a fan. The ventilation module 230 may circulate air inside the garment storage box 200. The ventilation module 230 may discharge the air inside the garment storage box 200 to the outside of the garment storage box 200, and allow air from outside the garment storage box 200 to flow into the garment storage box 200.

The sensor module 240 may be provided inside the case 210. For example, the sensor module 240 may be attached to an inner side surface of the case 210. The sensor module 240 may include a humidity sensor. The sensor module 240 may detect the humidity inside the garment storage box 200. The sensor module 240 may include an odor sensor. The sensor module 240 may detect an odor inside the garment storage box 200.

The garment storage box 200 according to an embodiment of the disclosure may further include at least one processor (not shown). The at least one processor may control the overall operation of the garment storage box 200. The at least one processor may control start and stop of an operation of the ventilation module 230. The at least one processor may control an operation of the ventilation module 230 based on the humidity inside the garment storage box 200 detected by the sensor module 240.

Figure 4:
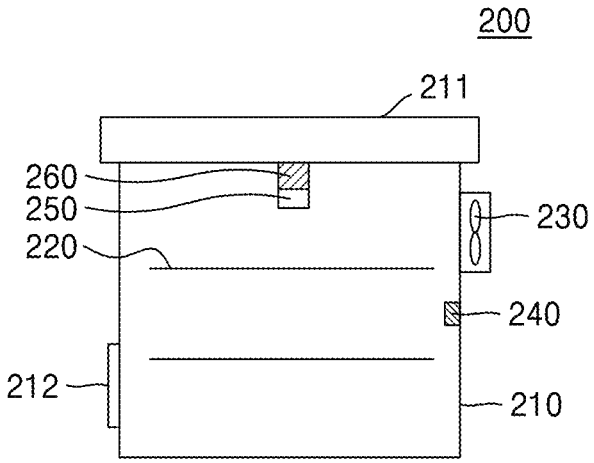
FIG. 4 is a front view of a garment storage box according to an embodiment of the disclosure.

FIG. 4 is a front view of the garment storage box 200 according to an embodiment of the disclosure. The garment storage box 200 according to an embodiment of the disclosure may include the case 210, the garment shelf 220, the ventilation module 230, the sensor module 240, an identification module 250, and a display 260.

The case 210 may include a cover 211. The cover 211 may be coupled to one surface of the case 210. For example, the cover 211 may be coupled to the upper surface of the case 210 to be rotatable or in a sliding structure. The cover 211 may open or close the garment storage box 200. The cover 211 may be opened when putting a garment into the garment storage box 200 or taking a garment out of the garment storage box 200. When garments are stored in the garment storage box 200, the cover 211 may remain closed.

The case 210 may include a vent 212. The vent 212 may be formed on one surface of the case 210. For example, the vent 212 may be formed to penetrate one side of a lower side surface of the case 210. The vent 212 may be arranged on a side surface opposite to the side surface where the ventilation module 230 is arranged. The vent 212 may be arranged at a different height from the ventilation module 230. However, the disclosure is not limited thereto, and the vent 212 may be arranged to face the ventilation module 230. The vent 212 may discharge air inside the garment storage box 200 to the outside of the garment storage box 200. The vent 212 may allow air from outside the garment storage box 200 to flow into the garment storage box 200.

The garment shelf 220 may be provided on an inner surface of case 210. The garment shelf 220 may have a structure that facilitates ventilation at an edge thereof. For example, the garment shelf 220 may have a structure in which a plurality of bars are arranged in parallel. However, the disclosure is not limited thereto, and the garment shelf 220 may have a structure for supporting stored garments, such as a plate structure, a basket structure, or a mesh structure.

The ventilation module 230 may be arranged on a side surface opposite to the side surface where the vent 212 is arranged. The ventilation module 230 may be arranged at a different height from the vent 212. However, the disclosure is not limited thereto, and the ventilation module 230 may be arranged to face the vent 212.

The sensor module 240 may include a humidity sensor. The sensor module 240 may be provided inside the case 210. For example, the sensor module 240 may be attached to an inner side surface of the case 210. However, the disclosure is not limited thereto, and the sensor module 240 may be arranged in a position where the humidity inside the garment storage box 200 may be efficiently detected.

The identification module 250 may be arranged in the case 210. For example, the identification module 250 may be arranged on an inner surface of the case 210. However, the disclosure is not limited thereto, and the identification module 250 may be arranged on an outer surface of the case 210. The identification module 250 may generate a radio signal to identify an object related to a garment stored in the garment storage box 200. The identification module 250 may be a radio-frequency identification (RFID) reader.

In a case in which the identification module 250 is an RFID reader, the identification module 250 may identify an RFID tag attached to a garment stored in the garment storage box 200. A passive RFID tag may be attached to a garment. For example, an apparel company may attach an RFID tag to a garment, and then sell the garment. For example, a user may purchase a garment and then attach an RFID tag to the garment at home. The identification module 250 may generate a radio-frequency (RF) signal. When the tag attached to the garment receives the RF signal and transmits a response signal, the identification module 250 may receive the response signal. The identification module 250 may obtain information related to the garment based on the response signal. For example, the identification module 250 may periodically transmit wireless power and receive a passive RFID signal to recognize the type of a garment inside the garment storage box 200. For example, the user may cause the identification module 250 to recognize a tag of a garment, and then store the garment in the identification module 250.

The display 260 may be arranged on an outer surface of the case 210. For example, the display 260 may be arranged at a central or upper portion of an outer side surface of the case 210. For example, the display 260 may be a screen display module including a liquid-crystal display (LCD) or an organic light-emitting diode. As another example, the display 260 may be a light-emitting module including light-emitting diodes. The display 260 may display information related to a garment stored in the garment storage box 200. For example, when a garment to be found is inside the garment storage box 200, the display 260 may display a guide screen or emit light to indicate that the garment to be found is in the garment storage box 200.

Figure 5:
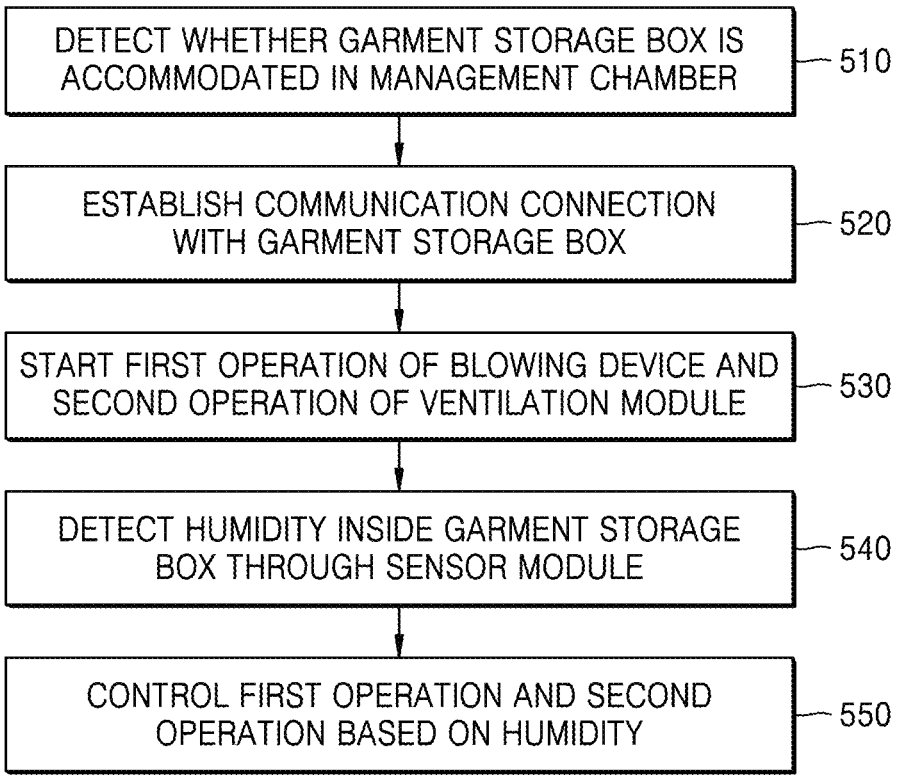
FIG. 5 is a flowchart of a method of controlling a garment management device, according to an embodiment of the disclosure.

FIG. 5 is a flowchart of a method of controlling the garment management device 1, according to an embodiment of the disclosure.

In operation 510, the garment management device 1 according to an embodiment of the disclosure may detect whether the garment storage box 200 is accommodated in the management chamber 12. The garment management device 1 may detect whether an object is present in the management chamber 12. The garment management device 1 may detect whether the garment storage box 200 is present in the management chamber 12.

In operation 520, the garment management device 1 according to an embodiment of the disclosure may establish a communication connection with the garment storage box 200. The garment management device 1 may initiate an attempt to control the garment storage box 200 accommodated in the management chamber 12. The garment management device 1 may establish a wireless or wired communication connection with the garment storage box 200 accommodated in the management chamber 12. For example, the garment management device 1 may establish a wireless communication connection with the garment storage box 200 accommodated in the management chamber 12 by using RFID or near-field communication (NFC). For example, the garment management device 1 may be connected to the garment storage box 200 accommodated in the management chamber 12 through the connector 190*a* to establish a wired communication connection.

In operation 530, the garment management device 1 according to an embodiment of the disclosure may start a first operation of the blowing device 80 and a second operation of the ventilation module 230. The garment management device 1 may control the garment storage box 200 accommodated in the management chamber 12. The garment management device 1 may operate the ventilation module 230 of the garment storage box 200 while operating the blowing device 80.

In operation 540, the garment management device 1 according to an embodiment of the disclosure may detect the humidity inside the garment storage box 200 through the sensor module 240. The sensor module 240 of the garment storage box 200 may detect the humidity inside the garment storage box 200. The garment management device 1 may obtain information about the humidity inside the garment storage box 200 from the sensor module 240 of the garment storage box 200 accommodated in the management chamber 12.

In operation 550, the garment management device 1 according to an embodiment of the disclosure may control the first operation and the second operation based on the humidity. The garment management device 1 may control the operation of the blowing device 80 and the operation of the ventilation module 230 according to the humidity inside the garment storage box 200. When the humidity inside the garment storage box 200 is outside a preset humidity range, the garment management device 1 may maintain the first operation and the second operation. When the humidity inside the garment storage box 200 is within the preset humidity range, the garment management device 1 may stop the first operation and the second operation. The garment management device 1 may control the humidity inside the garment storage box 200 to be within the preset humidity range. The garment management device 1 may remove moisture from a garment stored in the garment storage box 200 without having to take the garment out of the garment storage box 200. The garment management device 1 may easily manage garments stored in the garment storage box 200 for a long period of time.

Figure 6:
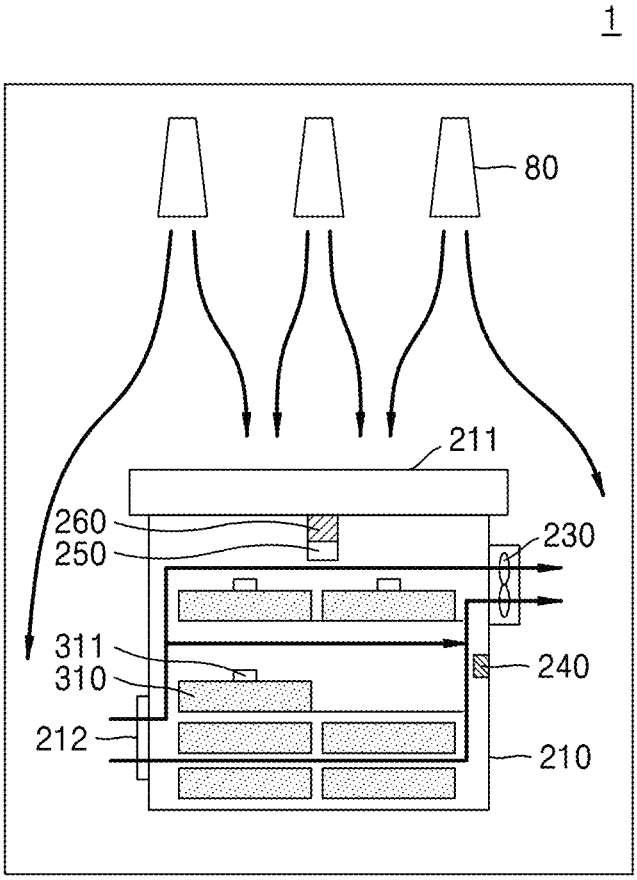
FIG. 6 is a diagram illustrating a flow of air inside a garment management device in which a garment storage box is accommodated, according to an embodiment of the disclosure.

FIG. 6 is a diagram illustrating a flow of air inside the garment management device 1 in which the garment storage box 200 is accommodated, according to an embodiment of the disclosure.

The blowing device 80 of the garment management device 1 may be arranged at an upper part of the garment management device 1. The blowing device 80 may discharge heated dry air toward the garment storage box 200. The heated dry air may surround the garment storage box 200. When the ventilation module 230 of the garment storage box 200 operates, the heated dry air may flow into the garment storage box 200 through the vent 212 of the garment storage box 200. The heated dry air introduced into the garment storage box 200 may pass through a garment 310 stored in the garment storage box 200. Moist air inside the garment storage box 200 may be discharged to the outside of the garment storage box 200 through the ventilation module 230.

When the humidity inside the garment storage box 200 increases, the garment management device 1 may display a notification for notifying the user to manage the garment stored in the garment storage box 200. The garment management device 1 may recommend a course for managing the garment stored in the garment storage box 200. The garment management device 1 may detect whether the garment storage box 200 is located inside the management chamber 12. The garment management device 1 may start an operation. The garment management device 1 may operate the ventilation module 230 of the garment storage box 200. The garment management device 1 may check whether the humidity inside the garment storage box 200 is less than or equal to a preset threshold value. When the humidity inside the garment storage box 200 is less than or equal to the preset threshold value, the garment management device 1 may terminate the operation of the garment management device 1 and the operation of the ventilation module 230. Accordingly, the garment management device 1 may manage garments stored in the garment storage box 200 in conjunction with the intelligent garment storage box 200.

When the humidity inside the garment storage box 200 is high or a certain period of time has elapsed after using a management course of the garment management device 1, the garment management device may display a notification through an output interface of the garment management device 1 or through a user terminal. The garment management device 1 may recommend a course for managing the garment stored in the garment storage box 200. The garment management device 1 may start an operation with the recommended course. The garment management device 1 may transmit, to the garment storage box 200, an operation signal for operating the ventilation module 230 of the garment storage box 200. The garment management device 1 may start an operation of the ventilation module 230.

The garment management device 1 may obtain the humidity inside the garment storage box 200 from the sensor module 240 of the garment storage box 200. The garment management device 1 may check whether the humidity inside the garment storage box 200 is less than or equal to a preset threshold value. When the humidity inside the garment storage box 200 is less than or equal to a preset threshold value, the garment management device 1 may terminate the operation of the ventilation module 230. When the humidity inside the garment storage box 200 is less than or equal to the preset threshold value, the garment management device 1 may terminate the course of the garment management device 1. The garment management device 1 may display that the course of the garment management device 1 has been completed, through the output interface of the garment management device 1 or through a user terminal.

FIG. 7 is a table showing controlling an operation of the blowing device 80 of the garment management device 1 and an operation of the ventilation module 230 of the garment storage box 200 according to the humidity inside the garment storage box 200, according to an embodiment of the disclosure.

Based on the humidity inside the garment storage box 200 being greater than or equal to a threshold value, the garment management device 1 may maintain a first operation of the blowing device 80 of the garment management device 1. Based on the humidity inside the garment storage box 200 being greater than or equal to the threshold value, the garment management device 1 may maintain a second operation of the ventilation module 230 of the garment storage box 200. Based on the humidity inside the garment storage box 200 being less than the threshold value, the garment management device 1 may stop the first operation of the blowing device 80 of the garment management device 1. Based on the humidity inside the garment storage box 200 being less than the threshold value, the garment management device 1 may stop the second operation of the ventilation module 230 of the garment storage box 200.

For example, when the humidity inside the garment storage box 200 is greater than or equal to 0% but less than 60%, the garment management device 1 may stop the first operation of the blowing device 80. For example, when the humidity inside the garment storage box 200 is greater than or equal to 0% but less than 60%, the garment management device 1 may stop the second operation of the ventilation module 230. For example, when the humidity inside the garment storage box 200 is between 60% and 100%, the garment management device 1 may start the first operation of the blowing device 80. For example, when the humidity inside the garment storage box 200 is between 60% and 100%, the garment management device 1 may start the second operation of the ventilation module 230.

Figure 8:
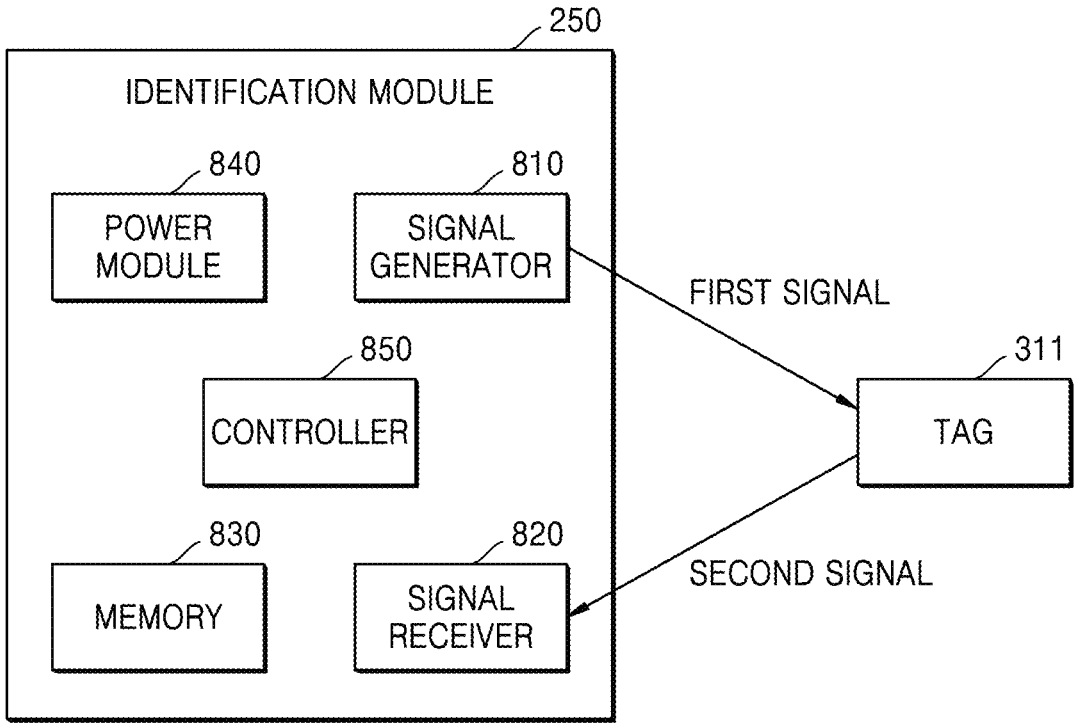
FIG. 8 is a block diagram illustrating an identification module of a garment storage box and a tag of a garment, according to an embodiment of the disclosure.

FIG. 8 is a block diagram illustrating the identification module 250 of the garment storage box 200 and a tag 311 of the garment 310, according to an embodiment of the disclosure. The identification module 250 may include a signal generator 810, a signal receiver 820, a memory 830, a power module 840, and a controller 850.

The signal generator 810 may generate a first signal that is an RF signal for identifying the tag 311. The signal generator 810 may transmit the first signal from inside the garment storage box 200. The tag 311 may receive the first signal. In response to the first signal, the tag 311 may transmit a second signal, which is an RF signal including garment information. The signal receiver 820 may receive the second signal.

The memory 830 may store the garment information included in the second signal. The power module 840 may include a power module configured to supply power for the identification module 250 to operate. The controller 850 may control the overall operation of the identification module 250.

Figure 9:
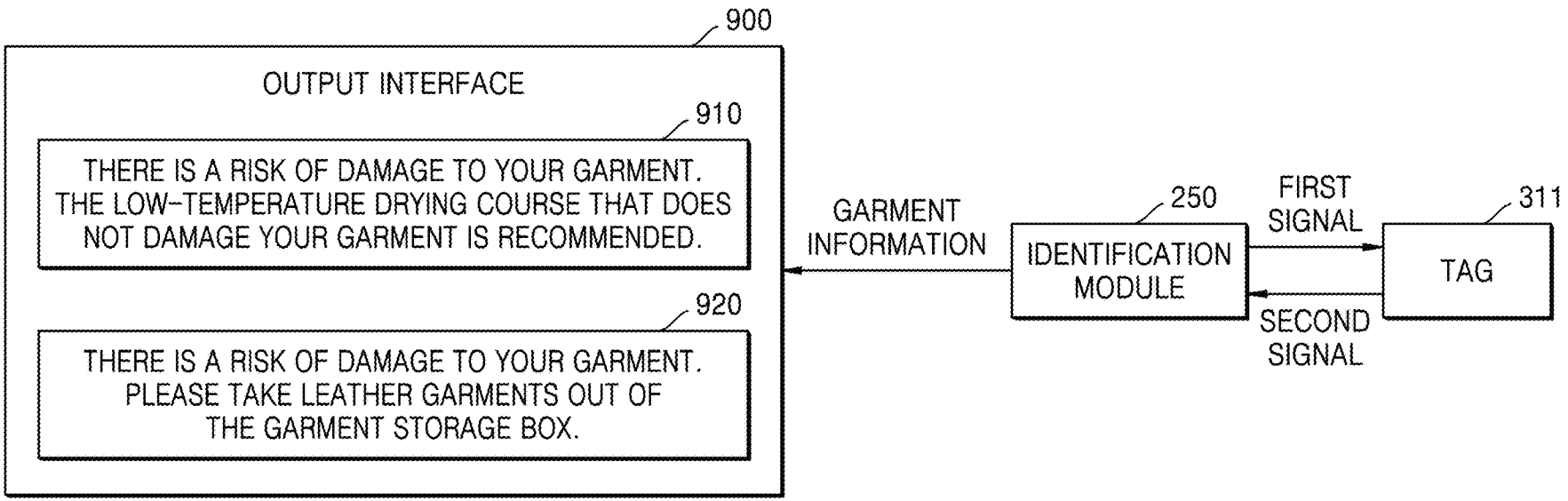
FIG. 9 is a diagram illustrating displaying garment information read from a tag of a garment, on an output interface of a garment management device, according to an embodiment of the disclosure.

FIG. 9 is a diagram illustrating displaying garment information read from the tag 311 of the garment 310, on an output interface 900 of the garment management device 1, according to an embodiment of the disclosure.

The identification module 250 of the garment storage box 200 may transmit a first signal to the tag 311. The identification module 250 may receive a second signal including garment information from the tag 311. The identification module 250 may transmit the garment information to the garment management device 1. For example, the identification module 250 may transmit the garment information to the output interface 900 of the garment management device 1.

The at least one processor of the garment management device 1 may receive the garment information related to the garment 310 stored in the garment storage box 200, from the tag 311 of the garment 310 through the identification module 250. The at least one processor may control a first operation of the blowing device 80 of the garment management device 1 based on the garment information. The at least one processor may control a second operation of the ventilation module 230 of the garment storage box 200 based on the garment information.

The garment information may include at least one of the type of the garment 310, the shape of the garment 310, the size of the garment 310, the material of the garment 310, or the color of the garment 310. For example, the garment information may indicate that the type of the garment 310 is coat. For example, the garment information may include a picture or photo file showing the shape of the garment 310. For example, the garment information may indicate that the size of the garment 310 is large. For example, the garment information may indicate that the material of the garment 310 is a mixture of nylon and polyester. For example, the garment information may indicate that the color of the garment 310 is gray.

The at least one processor may analyze the types, number, and materials of garments, which are included in the garment information, to select a course in which the garment management device 1 is to operate. The at least one processor may analyze the types, number, and materials of garments, which are included in the garment information, to set the amount of steam to be generated when the garment management device 1 operates. The at least one processor may analyze the types, number, and materials of garments, which are included in the garment information, to set the temperature of steam to be generated when the garment management device 1 operates. The at least one processor may analyze the types, number, and materials of garments, which are included in the garment information, to set the temperature of hot air to be generated when the garment management device 1 operates.

The output interface 900 of the garment management device 1 may be arranged on an outer surface of the garment management device 1. The at least one processor of the garment management device 1 may provide, through the output interface 900, a precaution related to the garment 310 stored in the garment storage box 200, based on the garment information. The at least one processor may display, through the output interface 900, a first user interface (UI) 910 and a second UI 920 for providing precautions related to the garment 310.

The first UI 910 may display a guide for recommending an alternative course that may prevent damage to a garment. For example, the first UI 910 may display a guide stating "There is a risk of damage to your garment. The low-temperature drying course that does not damage your garment is recommended".

The second UI 920 may display a guide for notifying that a particular material or type of garment needs to be excluded. For example, the second UI 920 may display a guide stating "There is a risk of damage to your garment. Please take leather garments out of the garment storage box".

FIG. 9 shows that the output interface 900 of the garment management device 1 displays the first UI 910 and the second UI 920 for notifying of precautions related to the garment 310. However, the disclosure is not limited thereto, and in a case in which the garment storage box 200 is located outside the garment management device 1, the first UI 910 and the second UI 920 notifying of the precautions related to the garment 310 may be displayed through the display 260 of the garment storage box 200.

Figure 10:
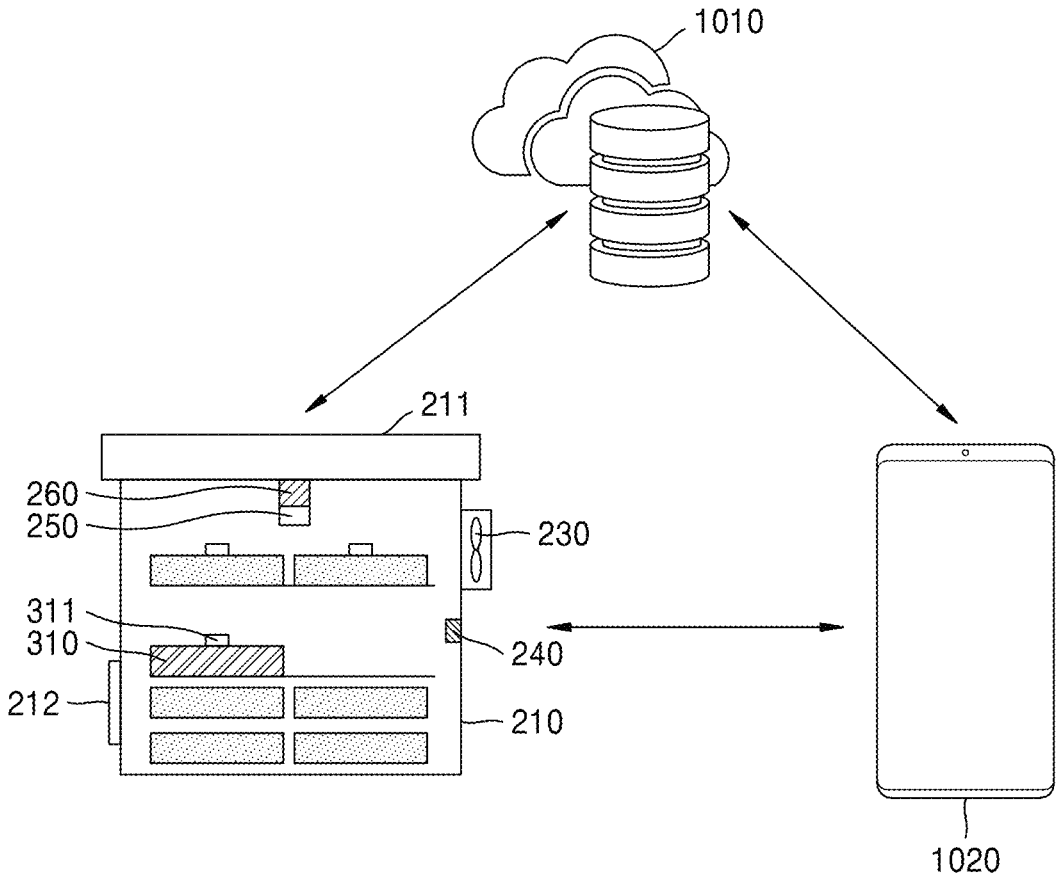
FIG. 10 is a diagram illustrating finding a garment storage box in which a desired garment is stored, according to an embodiment of the disclosure.

FIG. 10 is a diagram illustrating finding the garment storage box 200 in which a desired garment 310 is stored, according to an embodiment of the disclosure.

The garment storage box 200 may identify garment information input to the tag 311 of the garment 310, through the identification module 250. The garment information may include at least one of the type of the garment 310, the shape of the garment 310, the size of the garment 310, the material of the garment 310, or the color of the garment 310.

The garment storage box 200 may match the garment information with identification information. The identification information may include an identifier (ID) of the garment storage box 200. The garment storage box 200 may match the ID of the garment storage box 200 with the garment 310.

The garment storage box 200 may obtain location information through the identification module 250. The location information may include information related to the location of the garment storage box 200 inside a home.

The garment storage box 200 may store the garment information, the identification information, and the location information in a server 1010. The garment storage box 200 may be connected to the server 1010 through wireless communication. The garment storage box 200 may transmit the garment information, the identification information, and the location information to the server 1010. The server 1010 may store the garment information, the identification information, and the location information received from the garment storage box 200.

The garment storage box 200 may receive information about a desired garment, from a terminal 1020. The terminal 1020 may receive the information about the desired garment from the user. The terminal 1020 may transmit the information about the desired garment to the garment storage box 200. The garment storage box 200 may receive the information about the desired garment transmitted from the terminal 1020.

The garment storage box 200 may identify the storage location of the garment 310 based on the garment information, the identification information, and the location information. The garment storage box 200 may identify the storage location of the garment 310 through the server 1010. In response to an event in which the garment storage box 200 receives the information about the desired garment, the server 1010 may transmit the stored garment information, identification information, and location information to the garment storage box 200. The garment storage box 200 may identify the location of the garment storage box 200 in which the garment 310 is stored, based on the garment information, the identification information, and the location information. Accordingly, the user may easily find the garment storage box 200 in which the desired garment 310 is stored.

Figure 11:
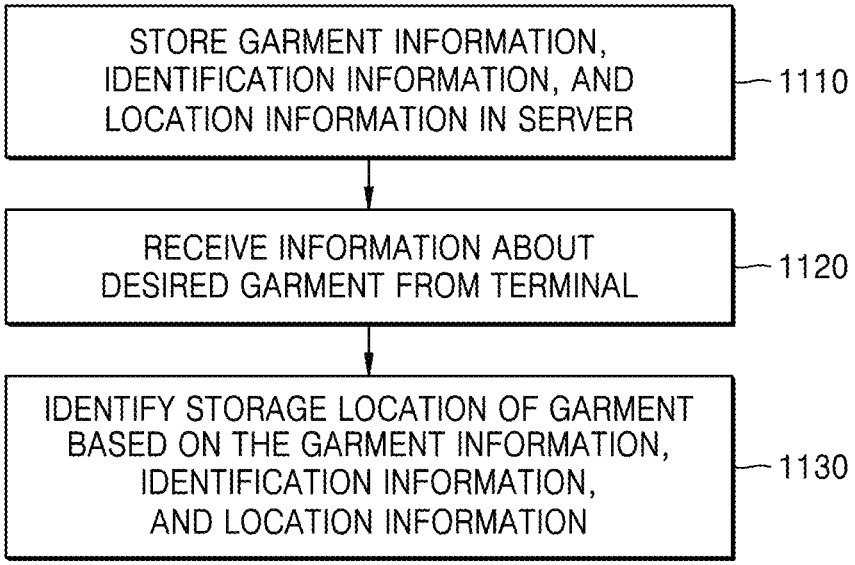
FIG. 11 is a flowchart showing finding a desired garment, according to an embodiment of the disclosure.

FIG. 11 is a flowchart showing finding a desired garment 310, according to an embodiment of the disclosure.

In operation 1110, the garment management device 1 according to an embodiment of the disclosure may store garment information, identification information, and location information in the server 1010. The garment management device 1 may accommodate the garment storage box 200 in the management chamber 12. The garment management device 1 may obtain garment information, identification information, and location information from the garment storage box 200. The garment management device 1 accommodating the garment storage box 200 may be connected to the server 1010 through wireless communication. The garment management device 1 may transmit the garment information, the identification information, and the location information to the server 1010. The server 1010 may store the garment information, the identification information, and the location information, which are received from the garment management device 1.

In operation 1120, the garment management device 1 according to an embodiment of the disclosure may receive information about a desired garment, from the terminal 1020. The terminal 1020 may receive the information about the desired garment from the user. The terminal 1020 may transmit the information about the desired garment to the garment management device 1. The garment management device 1 may receive the information about the desired garment transmitted from the terminal 1020.

In operation 1130, the garment management device 1 according to an embodiment of the disclosure may identify the storage location of the garment 310 based on the garment information, the identification information, and the location information. The garment management device 1 may identify the storage location of the garment 310 through the server 1010. In response to an event in which the garment management device 1 receives the information about the desired garment, the server 1010 may transmit the stored garment information, identification information, and location information to the garment management device 1. The garment management device 1 may identify the location of the garment storage box 200 in which the garment 310 is stored, based on the garment information, the identification information, and the location information.

Figure 12:
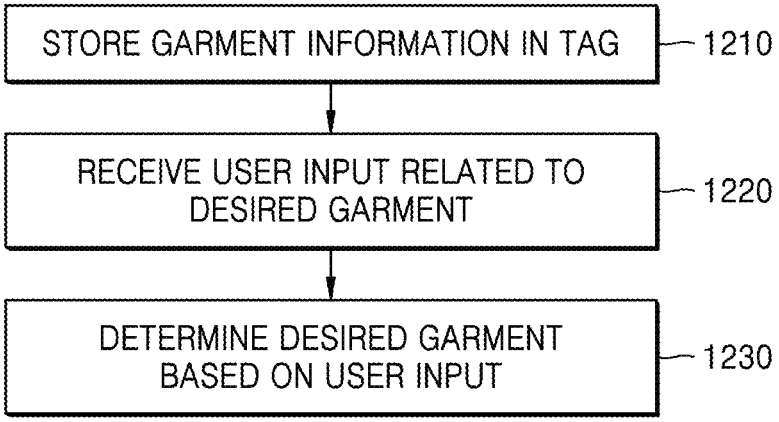
FIG. 12 is a flowchart showing determining a desired garment, according to an embodiment of the disclosure.

FIG. 12 is a flowchart showing determining a desired garment 310, according to an embodiment of the disclosure.

In operation 1210, garment information may be stored in the tag 311. The user or a garment seller may store the garment information in the tag 311. For example, the user may input the garment information to the tag 311 to store it. For example, the garment seller may input the garment information to the tag 311 and then sell the garment 310.

In an embodiment of the disclosure, the garment information may be stored in the tag 311 by using RFID. For example, the terminal 1020 may include an application for storing garment information in the tag 311. For example, the terminal 1020 may recognize the tag 311 by using a tagging method. For example, the terminal 1020 may photograph the garment 310 with a camera included in the terminal 1020, and store the captured image in the tag 311.

In operation 1220, the garment management device 1 according to an embodiment of the disclosure may receive a user input related to a desired garment. The user may enter an input related to the desired garment 310 into the terminal 1020. For example, the user may enter, into the terminal 1020, an input regarding the color of the desired garment 310 to find, the owner of the desired garment 310, whether the desired garment 310 is a top or bottom, whether the desired garment 310 is a long or short garment, or whether the desired garment 310 is summer or winter wear. The terminal 1020 may transmit the user input related to the desired garment to the garment management device 1. The garment management device 1 may receive the user input related to the desired garment transmitted from the terminal 1020.

In operation 1230, the garment management device 1 according to an embodiment of the disclosure may determine the desired garment based on the user input. The garment management device 1 may load garment information corresponding to the received user input related to the desired garment. The garment management device 1 may identify the garment 310 corresponding to the user input related to the desired garment. The garment management device 1 may identify the location of the garment storage box 200 in which the garment 310 corresponding to the user input related to the desired garment is stored.

Figure 13:
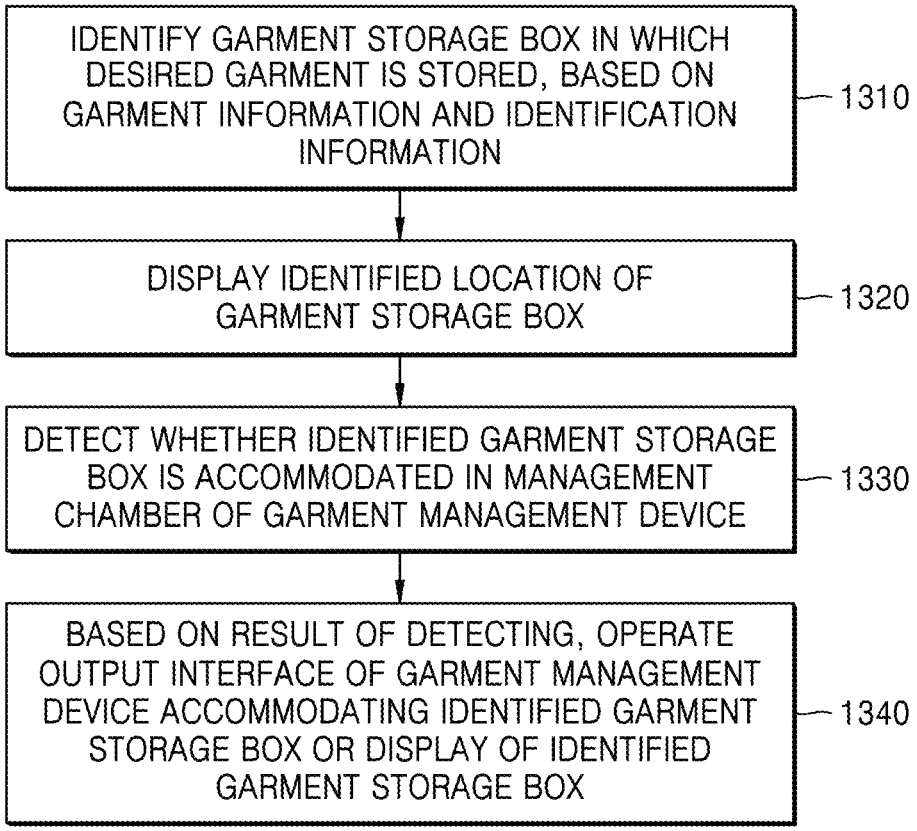
FIG. 13 is a flowchart showing displaying a garment storage box in which a desired garment is stored, according to an embodiment of the disclosure.

FIG. 13 is a flowchart showing displaying the garment storage box 200 in which the desired garment 310 is stored, according to an embodiment of the disclosure.

In operation 1310, the garment management device 1 according to an embodiment of the disclosure may identify the garment storage box 200 in which the desired garment 310 is stored, based on garment information and identification information. The garment management device 1 may receive the garment information and the identification information from the server 1010. The garment management device 1 may identify the garment storage box 200 in which the desired garment 310 is stored, based on the garment information and the identification information received from the server 1010.

In an embodiment of the disclosure, the garment storage box 200 may identify that the garment 310 is stored therein. The garment storage box 200 may identify the tag 311 attached to the garment 310 by using the identification module 250.

In an embodiment of the disclosure, the garment storage box 200 may identify the location of the garment 310 stored therein. The identification module 250 of the garment storage box 200 may identify the strength of an RF signal transmitted from the tag 311 attached to the garment 310. The identification module 250 may identify the location of the garment 310 based on the strength of the RF signal. For example, the identification module 250 may include at least one RF receiver. The at least one RF receiver may identify the strength of an RF signal. As the number of RF receivers included in the identification module 250 increases, the location of the garment 310 may be identified more accurately.

In an embodiment of the disclosure, the garment storage box 200 may identify a location inside a home. The garment storage box 200 may transmit its location as an RF signal. A plurality of ultra-wideband (UWB) sensors may be arranged inside the home. The plurality of UWB sensors may be connected to the server 1010. The server 1010 may identify the location of the garment storage box 200 by using the plurality of UWB sensors.

In operation 1320, the location of the identified garment storage box 200 may be displayed on the terminal 1020. The garment management device 1 according to an embodiment of the disclosure may transmit the location of the identified garment storage box 200 to the terminal 1020. The terminal 1020 may receive the location of the identified garment storage box 200 from the garment management device 1. The terminal 1020 may display the location of the garment storage box 200 received from the garment management device 1.

In operation 1330, the garment management device 1 according to an embodiment of the disclosure may detect whether the identified garment storage box 200 is accommodated in the management chamber 12 of the garment management device 1. The garment management device 1 may detect whether the garment storage box 200 in which the desired garment 310 is stored is accommodated in the management chamber 12, based on the garment information and the identification information received from the server 1010.

In operation 1340, the garment management device 1 according to an embodiment of the disclosure may operate, based on a result of the detecting, the output interface 900 of the garment management device 1 accommodating the identified garment storage box 200 or the display 260 of the identified garment storage box 200. Based on detecting that the garment storage box 200 storing the desired garment 310 is accommodated in the management chamber 12, the garment management device 1 may operate the output interface 900. For example, when the garment storage box 200 is accommodated in the management chamber 12, the garment management device 1 may emit light in the output interface 900. Based on detecting that the garment storage box 200 storing the desired garment 310 is located outside the garment management device 1, the garment management device 1 may operate the display 260 of the garment storage box 200. For example, when the garment storage box 200 is located outside the garment management device 1, the garment management device 1 may transmit a tracking signal that causes the display 260 to emit light. Accordingly, no matter where the garment storage box 200 storing the desired garment 310 is located, the user may easily identify the location of the garment storage box 200 storing the desired garment 310.

Figure 14:
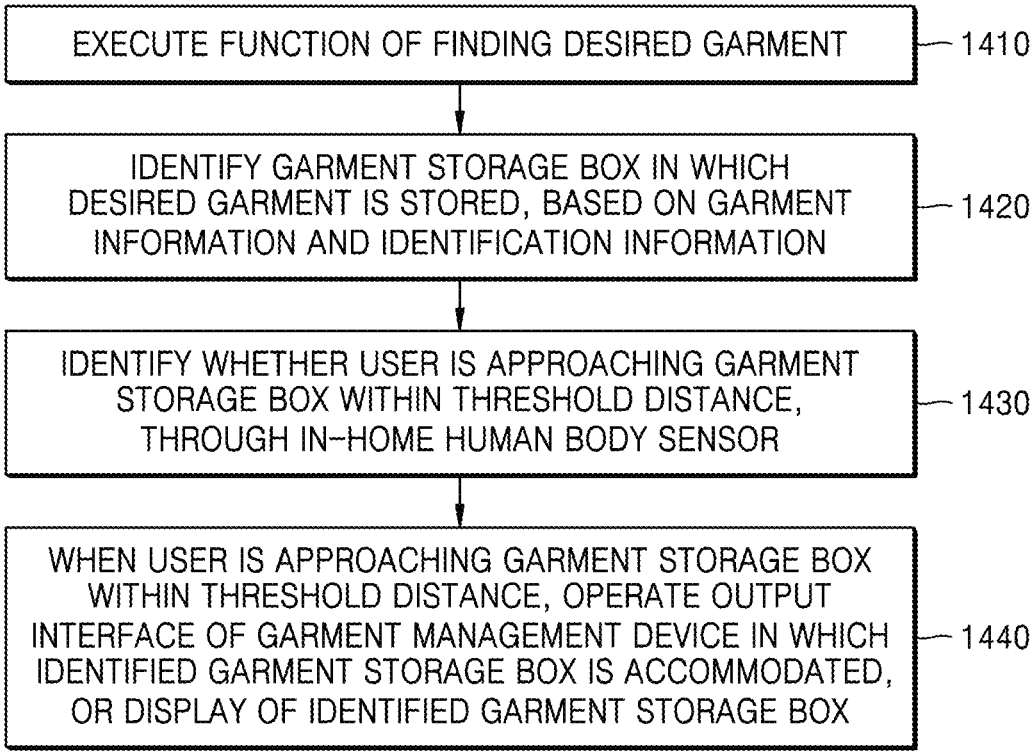
FIG. 14 is a flowchart showing detecting a user approaching and displaying a garment storage box in which a desired garment is stored, according to an embodiment of the disclosure.

FIG. 14 is a flowchart showing detecting the user approaching and displaying the garment storage box 200 in which the desired garment 310 is stored, according to an embodiment of the disclosure.

In operation 1410, the terminal 1020 may execute a function of finding a desired garment. The terminal 1020 may execute an application having a function of finding the desired garment 310.

In operation 1420, the garment management device 1 according to an embodiment of the disclosure may identify the garment storage box 200 in which the desired garment 310 is stored, based on garment information and identification information.

In operation 1430, the garment management device 1 according to an embodiment of the disclosure may identify whether the user is approaching the garment storage box 200 within a threshold distance, through an in-home human body sensor. A plurality of human body sensors may be arranged inside a home. The garment management device 1 may identify the location of the garment storage box 200. The garment management device 1 may identify whether the user is approaching the garment storage box 200 within the threshold distance, by using a human body sensor arranged near the garment storage box 200 from among the plurality of human body sensors.

In operation 1440, when the user is approaching the garment storage box 200 within the threshold distance, the garment management device 1 according to an embodiment of the disclosure may operate the output interface 900 of the garment management device 1 in which the identified garment storage box 200 is accommodated, or the display 260 of the identified garment storage box 200. The garment management device 1 may detect whether the user is approaching the garment storage box 200 within the threshold distance, by using the human body sensor arranged near the garment storage box 200. When the user is approaching the garment storage box 200 within the threshold distance and the garment storage box 200 is accommodated in the management chamber 12, the garment management device 1 may operate the output interface 900. When the user is approaching the garment storage box 200 within the threshold distance and the garment storage box 200 is located outside the garment management device 1, the garment management device 1 may transmit a tracking signal that causes the display 260 to emit light. Accordingly, when the user is approaching, within the threshold distance, the garment storage box 200 in which the desired garment 310 is stored, the location of the garment storage box 200 in which the desired garment 310 is stored may be easily identified.

Figure 15:
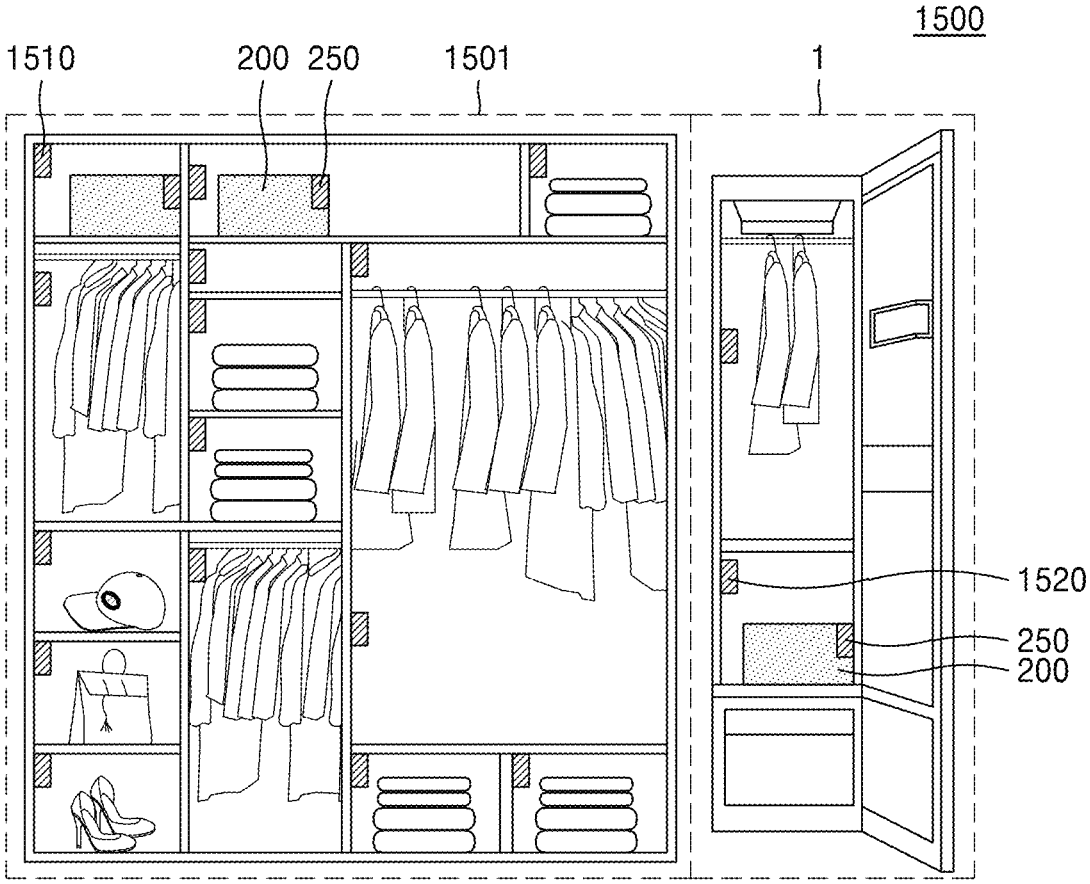
FIG. 15 is a diagram illustrating a garment management apparatus including a garment management device, according to an embodiment of the disclosure.

FIG. 15 is a diagram illustrating a garment management apparatus 1500 including the garment management device 1, according to an embodiment of the disclosure.

The garment management apparatus 1500 may include a garment storage chamber 1501 and the garment management device 1. The garment management apparatus 1500 may be a smart wardrobe in which a wardrobe and the garment management device 1 are integrated.

The garment storage chamber 1501 may include a plurality of identification modules 1510. The plurality of identification modules 1510 may be RFID readers.

At least one garment storage box 200 may be stored in the garment storage chamber 1501. At least one of the plurality of identification modules 1510 may be connected to the identification module 250 of the garment storage box 200 through wireless communication.

The garment management device 1 may include an identification module 1520. The identification module 1520 may be an RFID reader. The identification module 1520 may be connected to the identification module 250 of the garment storage box 200 through wireless communication.

The disclosure provides a garment management device for easily managing garments stored in a garment storage box for a long period of time, and easily reducing moisture in the garments stored in the garment storage box, a method of controlling the garment management device, and a garment storage box.

The disclosure provides a garment management device for allowing a user to easily find which garment storage box in a home a garment the user wants to find is located, a method of controlling the garment management device, and a garment storage box.

A garment management device 1 according to an embodiment of the disclosure may include a blowing device 80 configured to ventilate a garment 310, a management chamber 12 to accommodate a garment storage box 200 in which the garment 310 is stored, and at least one processor. The garment storage box 200 according to an embodiment of the disclosure may include a case 210, a garment shelf 220, a ventilation module 230, and a sensor module 240. The at least one processor according to an embodiment of the disclosure may be configured to detect whether the garment storage box 200 is accommodated in the management chamber 12. The at least one processor according to an embodiment of the disclosure may be further configured to establish a communication connection with the garment storage box 200. The at least one processor according to an embodiment of the disclosure may be further configured to start a first operation of the blowing device 80 and a second operation of the ventilation module 230. The at least one processor according to an embodiment of the disclosure may be further configured to detect the humidity inside the garment storage box 200 through the sensor module 240. The at least one processor according to an embodiment of the disclosure may be further configured to control the first operation and the second operation based on the humidity.

The at least one processor according to an embodiment of the disclosure may be further configured to, based on the humidity being greater than or equal to a threshold value, maintain the first operation and the second operation. The at least one processor according to an embodiment of the disclosure may be further configured to, based on the humidity being less than the threshold value, stop the first operation and the second operation.

The garment storage box 200 according to an embodiment of the disclosure may include an identification module 250. The at least one processor according to an embodiment of the disclosure may be further configured to receive garment information related to the garment 310 stored in the garment storage box 200 from a tag 311 of the garment 310 through the identification module 250. The at least one processor according to an embodiment of the disclosure may be further configured to control the first operation and the second operation based on the garment information.

The garment information according to an embodiment of the disclosure may include at least one of a type of the garment 310, a shape of the garment 310, a size of the garment 310, a material of the garment 310, or a color of the garment 310.

The garment management device 1 according to an embodiment of the disclosure may include an output interface 900. The at least one processor according to an embodiment of the disclosure may be further configured to notify, through the output interface 900, of precautions related to the garment 310 stored in the garment storage box 200, based on the garment information.

The at least one processor according to an embodiment of the disclosure may be further configured to store, in a server 1010, the garment information, identification information of the garment storage box 200, and location information. The at least one processor may be further configured to receive information about a desired garment from a terminal 1020. The at least one processor may be further configured to identify a storage location of the desired garment 310 corresponding to the information about the desired garment, based on the garment information, the identification information, and the location information.

The at least one processor according to an embodiment of the disclosure may be further configured to, based on the garment storage box 200 storing the desired garment 310 being detected in the management chamber 12, notify, through the output interface 900, of information that the desired garment 310 is stored in the garment storage box 200.

The garment storage box 200 according to an embodiment of the disclosure may include a display 260. The at least one processor according to an embodiment of the disclosure may be further configured to, based on the garment storage box 200 storing the desired garment 310 not being detected in the management chamber 12, transmit a tracking signal that operates the display 260.

A method of controlling the garment management device 1 according to an embodiment of the disclosure may include detecting whether the garment storage box 200 is accommodated in the management chamber 12. The method of controlling the garment management device 1 according to an embodiment of the disclosure may include establishing a communication connection with the garment storage box 200. The method of controlling the garment management device 1 according to an embodiment of the disclosure may include starting a first operation of the blowing device 80 and a second operation of the ventilation module 230 of the garment storage box 200. The method of controlling the garment management device 1 according to an embodiment of the disclosure may include detecting the humidity inside the garment storage box 200 through the sensor module 240 of the garment storage box 200. The method of controlling the garment management device 1 according to an embodiment of the disclosure may include controlling the first operation and the second operation based on the humidity.

The controlling of the first operation and the second operation according to an embodiment of the disclosure may include, based on the humidity being greater than or equal to a threshold value, maintaining the first operation and the second operation. The controlling of the first operation and the second operation according to an embodiment of the disclosure may include, based on the humidity being less than the threshold value, stopping the first operation and the second operation.

The method of controlling the garment management device 1 according to an embodiment of the disclosure may include receiving garment information related to the garment 310 stored in the garment storage box 200 from a tag 311 of the garment 310 through the identification module 250. The method of controlling the garment management device 1 according to an embodiment of the disclosure may include controlling the first operation and the second operation based on the garment information.

The method of controlling the garment management device 1 according to an embodiment of the disclosure may include notifying, through the output interface 900, of precautions related to the garment 310 stored in the garment storage box 200, based on the garment information.

The method of controlling the garment management device 1 according to an embodiment of the disclosure may include storing, in the server 1010, garment information, identification information of the garment storage box 200, and location information. The method of controlling the garment management device 1 according to an embodiment of the disclosure may include receiving information about a desired garment from the terminal 1020. The method of controlling the garment management device 1 according to an embodiment of the disclosure may include identifying a storage location of the desired garment 310 corresponding to the information about the desired garment, based on the garment information, the identification information, and the location information.

The method of controlling the garment management device 1 according to an embodiment of the disclosure may include, based on the garment storage box 200 storing the desired garment 310 being detected in the management chamber 12, notifying, through the output interface 900, of information that the desired garment 310 is stored in the garment storage box 200.

The method of controlling the garment management device 1 according to an embodiment of the disclosure may includes, based on the garment storage box 200 storing the desired garment 310 not being detected in the management chamber 12, transmitting a tracking signal that operates a display 260 of the garment storage box 200.

The garment storage box 200 according to an embodiment of the disclosure may include a case 210, a garment shelf 220, a ventilation module 230, a sensor module 240, and at least one processor. The at least one processor according to an embodiment of the disclosure may be configured to detect whether the garment storage box 200 is accommodated in the management chamber 12 of the garment management device 1. The at least one processor according to an embodiment of the disclosure may be further configured to establish a communication connection with the garment management device 1. The at least one processor according to an embodiment of the disclosure may be further configured to start a first operation of the blowing device 80 of the garment management device 1 and a second operation of the ventilation module 230. The at least one processor according to an embodiment of the disclosure may be further configured to detect the internal humidity through the sensor module 240. The at least one processor according to an embodiment of the disclosure may be further configured to control the first operation and the second operation based on the humidity. While an embodiment of the disclosure describes the at least one processor of the garment storage box 200 as controlling components of the garment management device 1, in various example embodiments of the disclosure a communication connection may be established between the at least one processor of the garment storage box 200 and at least one processor of the garment manage device 1 so as to transmit information to the garment management device 1, via the established communication connection, so that control of one or more components of the garment management device 1, such as the blowing device 80, is performed by the at least one processor of the garment management device 1.

The at least one processor according to an embodiment of the disclosure may be further configured to, based on the humidity being greater than or equal to a threshold value, maintain the first operation and the second operation. The at least one processor according to an embodiment of the disclosure may be further configured to, based on the humidity being less than the threshold value, stop the first operation and the second operation.

The garment storage box 200 according to an embodiment of the disclosure may include the identification module 250. The at least one processor according to an embodiment of the disclosure may be further configured to receive garment information related to the garment 310 stored in the garment storage box 200 from the tag 311 of the garment 310 through the identification module 250. The at least one processor according to an embodiment of the disclosure may be further configured to control the first operation and the second operation based on the garment information.

The garment information according to an embodiment of the disclosure may include at least one of a type of the garment 310, a shape of the garment 310, a size of the garment 310, a material of the garment 310, or a color of the garment 310.

The garment storage box 200 according to an embodiment of the disclosure may include the display 260. The at least one processor according to an embodiment of the disclosure may be further configured to notify, through the display 260, of precautions related to the garment 310 stored in the garment storage box 200, based on the garment information.

The garment management device, the method of controlling the garment management device, and the garment storage box according to the disclosure may reduce moisture of a garment stored in the garment storage box accommodated in the garment management device, thereby storing garments for a long period of time without having to take them out of the garment storage box.

In addition, the garment management device, the method of controlling the garment management device, and the garment storage box according to the disclosure allow a user to easily find which garment storage box in a home a garment the user wants to find is located.

The method according to an embodiment of the disclosure may be embodied as program commands executable by various computer devices, and recorded on a computer-readable medium. The computer-readable medium may include program commands, data files, data structures, or the like separately or in combinations. The program commands to be recorded on the medium may be specially designed and configured for the disclosure or may be well-known to and be usable by those skill in the art of computer software. Examples of the computer-readable recording medium include magnetic media such as hard disks, floppy disks, or magnetic tapes, optical media such as a compact disc read-only memory (CD-ROM) or a digital video disc (DVD), magneto-optical media such as a floptical disk, and hardware devices such as ROM, random-access memory (RAM), or flash memory, which are specially configured to store and execute program commands. Examples of the program commands include not only machine code, such as code made by a compiler, but also high-level language code that is executable by a computer by using an interpreter or the like.

Some embodiments of the disclosure may be implemented as a recording medium including computer-readable instructions such as a computer-executable program module. The computer-readable medium may be any available medium which is accessible by a computer, and may include a volatile or non-volatile medium and a removable or non-removable medium. Also, the computer-readable medium may include a computer storage medium and a communication medium. The computer storage media include both volatile and non-volatile, removable and non-removable media implemented in any method or technique for storing information such as computer readable instructions, data structures, program modules or other data. The communication media typically include computer-readable instructions, data structures, program modules, other data of a modulated data signal, or other transmission mechanisms, and examples thereof include an arbitrary information transmission medium. Also, some embodiments of the disclosure may be implemented as a computer program or a computer program product including computer-executable instructions such as a computer program executed by a computer.

A machine-readable storage medium may be provided in the form of a non-transitory storage medium. Here, the term 'non-transitory storage medium' refers to a tangible device and does not include a signal (e.g., an electromagnetic wave), and the term 'non-transitory storage medium' does not distinguish between a case where data is stored in a storage medium semi-permanently and a case where data is stored temporarily. For example, the 'non-transitory storage medium' may include a buffer in which data is temporarily stored.

According to an embodiment of the disclosure, methods according to various embodiments disclosed herein may be included in a computer program product and then provided. The computer program product may be traded as commodities between sellers and buyers. The computer program product may be distributed in the form of a machine-readable storage medium (e.g., a CD-ROM), or may be distributed online (e.g., downloaded or uploaded) through an application store or directly between two user devices (e.g., smart phones). In a case of online distribution, at least a portion of the computer program product (e.g., a downloadable app) may be temporarily stored in a machine-readable storage medium such as a manufacturer's server, an application store's server, or a memory of a relay server.

The invention claimed is:

1. A garment management device comprising:

a management chamber;

a blowing device configured to generate an airflow in the management chamber;

a garment storage box in which a garment is storable, and configured to be accommodatable in the management chamber, the garment storage box including:

a case, a garment shelf, a ventilation module configured to circulate air through the garment storage box, and a sensor module configured to detect humidity inside the garment storage box; and at least one processor configured to:

detect whether the garment storage box is accommodated in the management chamber, and when it is detected that the garment storage box is accommodated in the management chamber:

establish a communication connection with the garment storage box, and via the established communication connection:

operate the blowing device so that the airflow is generated in the management chamber, and operate the ventilation module so that the airflow in the management chamber is circulated through the garment storage box, detect the humidity inside the garment storage box through the sensor module while the airflow in the management chamber is circulated through the garment storage box, and based on the detected humidity, control operation of the blowing device and operation of the ventilation module.

2. The garment management device of claim 1, wherein the at least one processor is configured to:

based on the detected humidity being greater than a threshold value, maintain the operation of the blowing device and the operation of the ventilation module, and based on the detected humidity being less than the threshold value, stop the operation of the blowing device and the operation of the ventilation module.

3. The garment management device of claim 1, wherein the garment storage box includes an identification module, and the at least one processor is configured to, when a garment is stored in the garment storage box:

receive, through the identification module, garment information related to the garment stored in the garment storage box from a tag of the garment, and control the operation of the blowing device and the operation of the ventilation module based on the received garment information.

4. The garment management device of claim 3, wherein the garment information includes at least one of a type of the garment, a shape of the garment, a size of the garment, a material of the garment, or a color of the garment.

5. The garment management device of claim 3, further comprising:

an output interface, wherein the at least one processor is configured to, based on the received garment information, communicate, through the output interface, precautions related to the garment stored in the garment storage box.

6. The garment management device of claim 5, wherein the at least one processor is configured to:

store, in a server, the received garment information, identification information of the garment storage box, and location information of the garment storage box, receive information from a terminal indicating a desired garment, and identify a storage location of the desired garment indicated by the received information from the terminal, based on the stored garment information, the stored identification information, and the stored location information.

7. The garment management device of claim 6, wherein the at least one processor is configured to:

based on the garment storage box storing the desired garment being detected in the management chamber, communicate, through the output interface, information that the desired garment is stored in the garment storage box.

8. The garment management device of claim 6, wherein the garment storage box includes a display, and the at least one processor is configured to:

based on the garment storage box storing the desired garment not being detected in the management chamber, transmit a tracking signal that operates the display of the garment storage box.

9. A method of controlling a garment management device, the garment management device including a management chamber, a blowing device configured to generate an airflow in the management chamber, a garment storage box in which a garment is storable and configured to be accommodatable in the management chamber, the garment storage box including a ventilation module configured to circulate air through the garment box and a sensor module configured to detect humidity inside the garment storage box, the method comprising:

detecting whether the garment storage box is accommodated in the management chamber; and when it is detected that the garment storage box is accommodated in the management chamber:

establishing a communication connection with the garment storage box, and via the established communication connection:

operating the blowing device so that the airflow is generated in the management chamber, and operating the ventilation module so that the airflow in the management chamber is circulated through the garment storage box, detecting the humidity inside the garment storage box through the sensor module while the airflow in the management chamber is circulated through the garment storage box, and based on the detected humidity, controlling operation of the blowing device and operation of the ventilation module.

10. The method of claim 9, wherein the controlling of the operation of the blowing device and the operation of the ventilation module includes:

based on the detected humidity being greater than a threshold value, maintaining the operation of the blowing device and the operation of the ventilation module, and based on the detected humidity being less than the threshold value, stopping the operation of the blowing device and the operation of the ventilation module.

11. The method of claim 9, wherein the garment management device includes an identification module, and the method further comprising:

when a garment is stored in the garment storage box:

receiving, through the identification module, garment information related to the garment stored in the garment storage box from a tag of the garment, and controlling the operation of the blowing device and the operation of the ventilation module based on the received garment information.

12. The method of claim 11, wherein the garment management device includes an output interface, and the method further comprising:

communicating, through the output interface, precautions related to the garment stored in the garment storage box.

13. The method of claim 12, further comprising:

storing, in a server, the received garment information, identification information of the garment storage box, and location information of the garment storage box;

receiving information from a terminal indicating a desired garment; and identifying a storage location of the desired garment indicated by the received information from the terminal, based on the stored garment information, the stored identification information, and the stored location information.

14. The method of claim 13, further comprising:

based on the garment storage box storing the desired garment being detected in the management chamber, communicating, through the output interface, information that the desired garment is stored in the garment storage box.

15. The method of claim 13, wherein the garment storage box includes a display, and the method further comprising:

based on the garment storage box storing the desired garment not being detected in the management chamber, transmitting a tracking signal that operates the display of the garment storage box.

16. A garment storage box that is removably accommodatable in a garment management chamber of a garment management device that circulates air in the garment management chamber for garment management in the garment management chamber, the garment storage box comprising:

a case configured to be removably positioned inside the garment management chamber of the garment management device;

a garment shelf;

a ventilation module configured to circulate air through the garment storage box so that the air circulated in the garment management chamber by the garment management device is drawn into the garment storage box;

a sensor module configured to detect humidity inside the garment storage box; and at least one processor configured to, with the garment storage box accommodated in the garment management chamber of the garment management device:

establish a communication connection with the garment management device, transmit information to the garment management device, via the established communication connection, so that a blowing device of the garment management device generates an airflow in the garment management chamber, operate the ventilation module so that the airflow in the garment management chamber is circulated through the garment storage box, detect the humidity inside the garment storage box through the sensor module while the airflow is circulated through the garment storage box, transmit information to the garment management device, via the established communication connection, so that the blowing device is controlled based on the detected humidity, and control operation of the ventilation module based on the detected humidity.

17. The garment storage box of claim 16, wherein the at least one processor is configured to:

based on the detected humidity being greater than a threshold value:

transmit information to the garment management device, via the established communication connection, so that the blowing device is controlled to maintain the airflow in the garment management chamber, and maintain the operation of the ventilation module, and based on the detected humidity being less than the threshold value:

transmit information to the garment management device, via the established communication connection, so that the blowing device is controlled to stop generating the airflow in the garment management chamber, and stop the operation of the ventilation module.

18. The garment storage box of claim 16, further comprising:

an identification module, wherein the at least one processor is configured to, when a garment is stored in the garment storage box:

receive, through the identification module, garment information related to the garment stored in the garment storage box from a tag of the garment, transmit information to the garment management device, via the established communication connection, so that the blowing device is controlled based on the received garment information, and control the operation of the ventilation module based on the received garment information.

19. The garment storage box of claim 18, wherein the garment information includes at least one of a type of the garment, a shape of the garment, a size of the garment, a material of the garment, or a color of the garment.

20. The garment storage box of claim 18, further comprising:

a display, wherein the at least one processor is configured to, based on the received garment information, communicate, through the display, precautions related to the garment stored in the garment storage box.

* * * * *